United States Patent [19]

Lemmers et al.

[11] Patent Number: 4,513,225

[45] Date of Patent: Apr. 23, 1985

[54] FLUORESCENT LAMP SERIES SYSTEM

[75] Inventors: Alfred E. Lemmers, Cleveland Heights; Edward E. Hammer, Mayfield Village, both of Ohio

[73] Assignee: General Electric Company, Schenectady, N.Y.

[21] Appl. No.: 449,088

[22] Filed: Dec. 13, 1982

[51] Int. Cl.[3] ..... H05B 37/00; H05B 39/00; H05B 41/00

[52] U.S. Cl. ..... 315/189; 315/96; 315/187; 315/245; 313/573

[58] Field of Search ..... 315/96, 97, 185, 187, 315/189, 186, 193, 245; 313/639, 573

[56] References Cited

U.S. PATENT DOCUMENTS

| | | | |
|---|---|---|---|
| 2,802,129 | 8/1957 | Meister et al. | 313/573 |
| 2,901,653 | 8/1959 | Gilmore | 313/573 X |
| 3,012,165 | 12/1961 | Schmidt | 313/573 |
| 3,372,301 | 3/1968 | Elfers | 315/97 X |
| 3,546,519 | 12/1970 | Hashimoto et al. | 313/573 |
| 4,145,638 | 3/1979 | Kaneda | 315/189 |
| 4,185,231 | 1/1980 | Colliton | 315/97 |
| 4,185,233 | 1/1980 | Riesland et al. | 315/189 |

*Primary Examiner*—Saxfield Chatmon

*Attorney, Agent, or Firm*—Philip L. Schlamp; Fred Jacob

[57] ABSTRACT

A pair of 48-inch long preheat fluorescent lamps, each one and a half inches diameter and consuming less than 10 watts power per foot of length, are connected in series with each other and with a ballast, for operation from 50 or 60 hertz a-c line voltage in the range of 200 to 300 volts. A starter switch is connected in parallel across each lamp. The lamp designs are specified such that they will start and operate in the circuit from the a-c line voltage.

7 Claims, 2 Drawing Figures

FLUORESCENT LAMP SERIES SYSTEM

BACKGROUND OF THE INVENTION

The invention is in the field of fluorescent lamp systems having one or more fluorescent lamps connected in electrical series with a ballast, for operation in the 200 to 300 volt range, such as standard values of 220, 240, or 277 volts.

Many fluorescent lamp systems have two lamps, usually positioned side-by-side, to provide more light from a larger source area than does a single lamp. Fluorescent lamps are manufactured in various different lengths, the 24-inch length and the 48-inch length being widely used in lighting systems. The voltage required for starting and operating fluorescent lamps increases approximately linearly with increased lamp length. Thus, a 48" lamp requires twice the voltage as a 24" lamp, two 24" lamps connected in series require essentially the same voltage as a single 48" lamp, and two 48" lamps in series require approximately twice the voltage as two 24" lamps in series.

A widely used type of fluorescent lamp circuit utilizes a voltage step-up transformer connected between the lamp(s) and the power line voltage supply, for providing suitable voltage to the lamp(s), such as is disclosed in U.S. Pat. No. 4,185,233 to Riesland et al. Another widely used fluorescent lamp circuit, which is more economical to manufacture, utilizes a current-limiting ballast impedance (such as an inductor, resistor, and/or capacitor) connected in series between the lamp(s) and the power line voltage source. The total length of the discharge path(s) of the lamp(s) in this circuit must be short enough so the lamp starting and operating voltages are sufficiently less than the line voltage. Therefore, such circuits have been limited to operating a single 24" (or shorter) fluorescent lamp from a 120-volt a-c line, and two 24" (or shorter) lamps connected in series (or a single 48" or shorter lamp) from a 220-volt, 240-volt, or 277-volt a-c line, the latter voltage being obtained from a 480-volt three-phase system. For convenience, these voltages are defined herein as being in a range of 200 to 300 volts.

FIG. 1 of the drawing shows a prior art two-lamp series-ballast circuit for operation from a standard line voltage in the range of 200 to 300 volts a.c. at a standard line frequency of 50 Hz or 60 Hz. A pair of conventional fluorescent lamps 11, 12, each of the 24-inch (20-watt) type, each contains a pair of cathodes 11*a*, 11*b* and 12*a*, 12*b* near the ends of the elongated 24-inch bulbs 11', 12'. An end of cathode 11*b* is connected to an end of cathode 12*b* by a conductor 13, thus connecting the lamps 11, 12 in electrical series. An end of cathode 12*a* is connected to a line voltage terminal 14, and a ballast inductor 16 and capacitor 17 are connected in series between an end of cathode 11*a* and the other line voltage terminal 18. The line voltage at terminals 14 and 18 is in the range of about 200 to 300 volts, e.g., a standard a-c line voltage of 220 volts, plus or minus ten percent, 240 volts, plus or minus ten percent, or 277 volts, plus or minus ten percent. The inductor 16 ballasts the lamps, i.e., it limits their operating current to a desired and safe value, and the capacitor 17 functions to shift the circuit power factor from lagging to leading, and also resonates with the inductor to increase the starting voltage for the lamps, in well-known manner.

A starter switch 21 is connected across the remaining ends of cathodes 11*a* and 11*b*, and a starter switch 22 is connected across the remaining ends of cathodes 12*a* and 12*b*. The starter switches 21, 22 may be the well-known glow starter switch, and they function by closing when the electrical power is first applied to the circuit, thereby causing preheat current to flow through the cathodes to heat them sufficiently to readily emit electrons to sustain a discharge current in the lamps. After about a second, the starter switches open and electric discharges occur in the lamps, causing a phosphor coating on the bulb to emit visible light.

It has been desirable to be able to have a lighting system employing a pair of 48-inch fluorescent lamps in series with a simple series ballast as shown in FIG. 1 for operation from a line voltage in the range of 200 to 300 volts, but this has not been achieved heretofore because of the higher voltage requirements of the 48-inch lamps as compared to the 24-inch lamps. Such a system, if it could be achieved, would provide about twice the light output of a 24-inch lamp system with a substantial increase in system efficacy at only a small increase in cost.

SUMMARY OF THE INVENTION

Objects of the invention are to provide a fluorescent lighting system having two series-connected 48-inch fluorescent lamps (or a single 96-inch lamp) ballasted by a series-connected impedance and operable in the 200 to 300 volt range such as from a standard 220-volt, 240-volt, or 277-volt a-c line source of about 50 Hz or 60 Hz.

The invention comprises, briefly and in a preferred embodiment, a fluorescent lamp lighting system having a total gas discharge length of about 96 inches, which can be provided by a single 96-inch lamp or more preferably by a pair of 48-inch lamps connected in electrical series. Ballast impedance means is connected in series combination with the lamp(s), and this combination is intended for operative connection to an a-c electrical power source in the range of about 200 to 300 volts at about 50 or 60 Hz. The lamp bulb(s), preferably of glass, have outside diameters of about one and one-half inches and are devoid of any internal conductive starting aid material therealong such as is commonly used in lamps containing krypton gas. The bulbs contain a small quantity of liquid mercury and a mixture of inert gases such as krypton and neon or argon in a volume ratio of about 80% to 20% at a pressure of about 1.5 torr. The lamps are of the cathode preheat type, designed to consume less than ten watts per foot of length, and a cathode preheat means is connected to each lamp.

DESCRIPTION OF THE PREFERRED EMBODIMENTS

Figure 2:
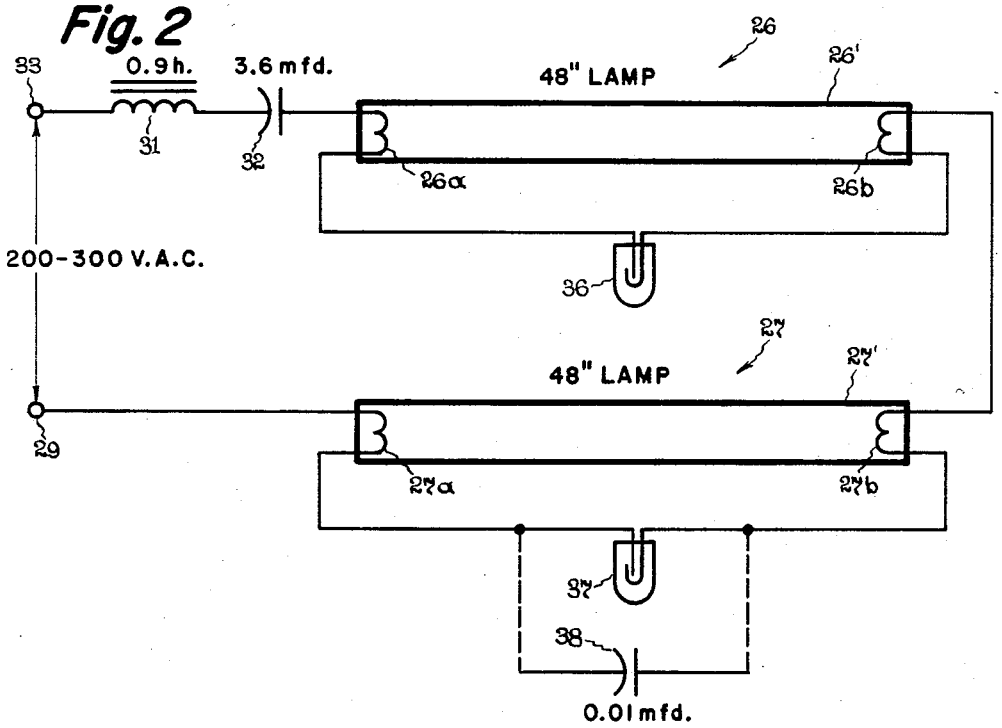
FIG. 2 is an electrical diagram of a preferred embodiment of the invention.

As shown in FIG. 2, in a preferred embodiment of the invention, a pair of 48-inch-long fluorescent lamps 26, 27 (nominally each consuming 35 watts of power or less, such types of lamps having recently been improved in efficacy and their power consumption having been reduced to 34 watts) each contains a pair of cathodes 26*a*, 26*b* and 27*a*, 27*b* near the ends of the elongated 48-inch glass bulbs 26' and 27'. An end of cathode 26*b* is connected to an end of cathode 27*b* by a conductor 28, thus connecting the lamps 26, 27 in electrical series. An end of cathode 27*a* is connected to a line voltage terminal 29, and a ballast inductor 31 and capacitor 32 are connected in series between an end of cathode 26*a* and the other line voltage terminal 33. The line voltage at terminals 29 and 33 is at or about 220 or 240 volts, i.e., a standard line voltage of nominal 220 or 240 volts, each with a nominal tolerance of plus or minus ten percent. These line voltages are common in various European countries.

Figure 1:
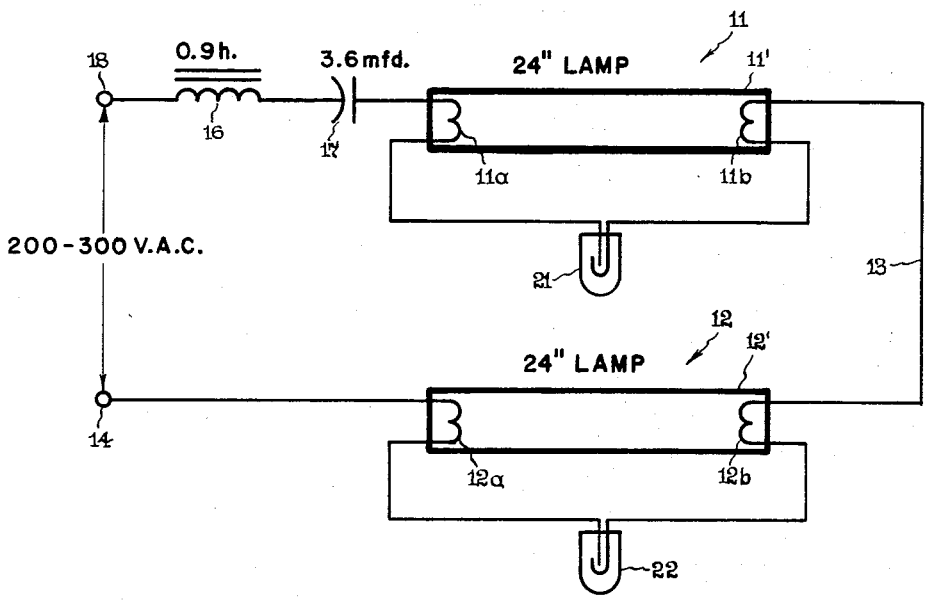
Fig. 1 (PRIOR ART)
FIG. 1 is an electrical diagram of a prior art fluorescent lamp system.

A starter switch 36 is connected across the remaining ends of cathodes 26*a* and 26*b*, and a starter switch 37 is connected across the remaining ends of cathodes 27*a* and 27*b*. The starter switches 36, 37, and ballast inductor 31 and capacitor 32, function similarly to the starting switches 21, 22 and ballast members 16, 17 of FIG. 1, described above.

In accordance with the invention, a pair of 48-inch fluorescent lamps 26, 27 will operate from the 220- or 240-volt line, whereas previously the lamps were limited to 24-inch types or equivalent overall length (per the prior art of FIG. 1), provided the lamps 26, 27 meet the following criteria. The glass bulbs 26', 27' have outside diameters of about one and one-half inches (known in the industry as T12 diameter) and are devoid of any internal conductive starting aid material along the bulbs, and contain a gas fill of mercury vapor and a mixture of krypton and neon or argon in a volume ratio of about 80% to 20% at a pressure of about 1.5 torr, for operating at a power consumption less than ten watts per foot of bulb length. These specified lamp parameter values may have typical manufacturing tolerances. The lamps also contain a fluorescent phosphor coating, in well-known manner.

The above-referenced Riesland patent discloses, in Column 2, lines 3–15, fluorescent lamps (intended to be 48-inch types) containing a gas fill of mercury and a mixture of krypton and neon or argon in a volume ratio of about 80% to 20% at a pressure of about 1.5 torr, and (contrary to the present invention) an internal starting aid coating of tin oxide. It is not understood why the present invention's 48-inch lamps containing the specified gases must be devoid of an internal starting aid in order to operate from 200 to 300 volts with a simple series ballast, but this discovery achieves the desirable operation of two 48-inch lamps (or a single 96" lamp, etc.) in the same or similar simple and economical ballast circuit that heretofore was believed capable of operating only lamps of half the length and hence approximately half the total light output.

It has been found that the lamps 26, 27 will start more readily and reliably if a starting capacitor 38 is connected across one of the lamps or across one of the starter switches 37. This capacitor 38 may have a nominal value of 0.01 microfarad, ballast capacitor 32 may be 3.6 microfarads, and ballast inductor 31 may be 0.9 henries. The invention is not limited to these particular values of components.

While preferred embodiments and modifications of the invention have been shown and described, various other embodiments and modifications thereof will become apparent to persons skilled in the art and will fall within the scope of the invention as defined in the following claims.

What we claim as new and desire to secure by Letters Patent of the United States is:

1. A fluorescent lamp lighting system for operation from an a-c voltage source in the range of about 200 to 300 volts at a frequency of about 50 or 60 hertz, comprising one or more fluorescent lamps connected to provide a total gas discharge path length of about 96 inches, cathode preheated means connected to said lamps, and ballast means connected in series combination with said gas discharge path to operate said lamps at a power consumption of less than ten watts per foot of lamp length, said series combination being adapted for connection across said a-c voltage source, said gas discharge path being contained in one or more lamp bulbs having outside diameters of about one and one-half inches, said lamp bulbs being devoid of any internal conductive starting aid material therealong and containing a gas fill of mercury vapor and a mixture of krypton and neon or argon in a volume ratio of about 80% to 20% at a pressure of about 1.5 torr.

2. A lighting system as claimed in claim 1, in which said gas discharge path is comprised of two lamps connected in electrical series and each having a length of about 48 inches.

3. A lighting system as claimed in claim 2, in which each lamp contains a pair of cathodes respectively near the ends thereof, means connecting an end of a cathode of the first lamp to an end of a cathode of the second lamp, first and second voltage input terminals, means connecting said ballast means between said first voltage input terminal and an end of the other cathode of the first lamp, means connecting said second voltage input terminal to an end of the other cathode of the second lamp, a first starter switch connected across the remaining ends of the cathodes of the first lamp, and a second starter switch connected across the remaining ends of the cathodes of the second lamp.

4. A lighting system as claimed in claim 3, including a starting capacitor connected across one of said starter switches.

5. A lighting system as claimed in claim 2, including a starting capacitor connected across one of said lamps.

6. A lighting system as claimed in claim 5, in which said ballast means comprises an inductor and a capacitor in series.

7. A lighting system as claimed in claim 1, in which said ballast means comprises an inductor and a capacitor connected in series.

* * * * *